US005323130A

United States Patent [19]

Arnold

[11] Patent Number: 5,323,130

[45] Date of Patent: Jun. 21, 1994

[54] MOLDED CASE CIRCUIT BREAKER MODULAR LINE STRAP ASSEMBLY

[75] Inventor: David Arnold, Chester, Conn.

[73] Assignee: General Electric Company, New York, N.Y.

[21] Appl. No.: 11,816

[22] Filed: Feb. 1, 1993

[51] Int. Cl.[5] ..... H01H 75/00

[52] U.S. Cl. ..... 335/16; 335/97

[58] Field of Search ..... 335/16, 147, 195, 132, 335/202, 97; 200/147 R

[56] References Cited

U.S. PATENT DOCUMENTS 4,589,052 5/1986 Dougherty ..... 361/94
4,649,455 3/1987 Scott ..... 361/93
4,754,247 6/1988 Raymont et al. ..... 335/202
4,975,667 12/1990 Morgan et al. ..... 335/202
5,004,878 4/1991 Seymour et al. ..... 200/144 R

*Primary Examiner*—Lincoln Donovan
*Attorney, Agent, or Firm*—Richard A. Menelly

[57] ABSTRACT

A molded case circuit breaker modular line strap assembly allows three components to be selectively interconnected for the different circuit breaker ampere ratings. A single component being used with the lower ampere ratings with additional components being additively assembled to accommodate the increased ampacity requirements with the higher ampere ratings.

11 Claims, 4 Drawing Sheets

MOLDED CASE CIRCUIT BREAKER MODULAR LINE STRAP ASSEMBLY

BACKGROUND OF THE INVENTION

U.S. Pat. No. 4,754,247 entitled "Molded Case Circuit Breaker Accessory Enclosure" describes a so-called "integrated" circuit breaker that provides both circuit interruption as well as accessory function. This Patent should be reviewed for its disclosure of an accessory cover mounted on the circuit breaker cover for providing access to field-installable accessory devices. The integrated circuit breaker includes an integrated circuit electronic trip unit which allows one circuit breaker design to be used over a wide range of ampere ratings in combination with a rating plug, also mounted in the circuit breaker cover. The electronic trip unit is described within U.S. Pat. No. 4,589,052 and the rating plug is described within U.S. Pat. No. 4,649,455.

The use of common circuit breaker components over a wide variety of ampere ratings could provide a strain on the circuit breaker case in the vicinity of the line and load terminal straps upon short circuit interruption when operated at high ampere loadings. The large electrodynamic forces exerted between adjacent line terminal straps and between adjacent load terminal straps exert corresponding large stress forces to the underlying case to which the line and load terminal straps are secured. U.S. Pat. No. 4,975,667 describes a glass-filled plastic inset that provides added strength to the line and load terminal straps to thereby allow common circuit breaker components to be used over a wider range of circuit breaker ampere ratings without adding to the circuit breaker cost.

The increase in the cost of the copper and silver materials used to fabricate the line strap components is reflected in the overall circuit breaker component costs. To reduce the number of components that must be inventoried, a large line strap that is designed for a 1600 ampere circuit breaker is also used within an 800 ampere circuit breaker. Since the remaining components are common within both circuit breaker designs, it would be cost beneficial to provide a line strap design that can be assembled from common lower current components and additively assemble the components to accommodate for the higher current rating.

Accordingly, one purpose of the invention is to provide a circuit breaker line strap modular assembly whereby the line strap components are additively combined for each circuit breaker ampere rating.

SUMMARY OF THE INVENTION

The invention comprises a molded case circuit breaker multi-component line strap assembly. The assembly components are additively combined to form line straps corresponding to increasing circuit breaker ampere ratings.

DESCRIPTION OF THE PREFERRED EMBODIMENT

Figure 1:
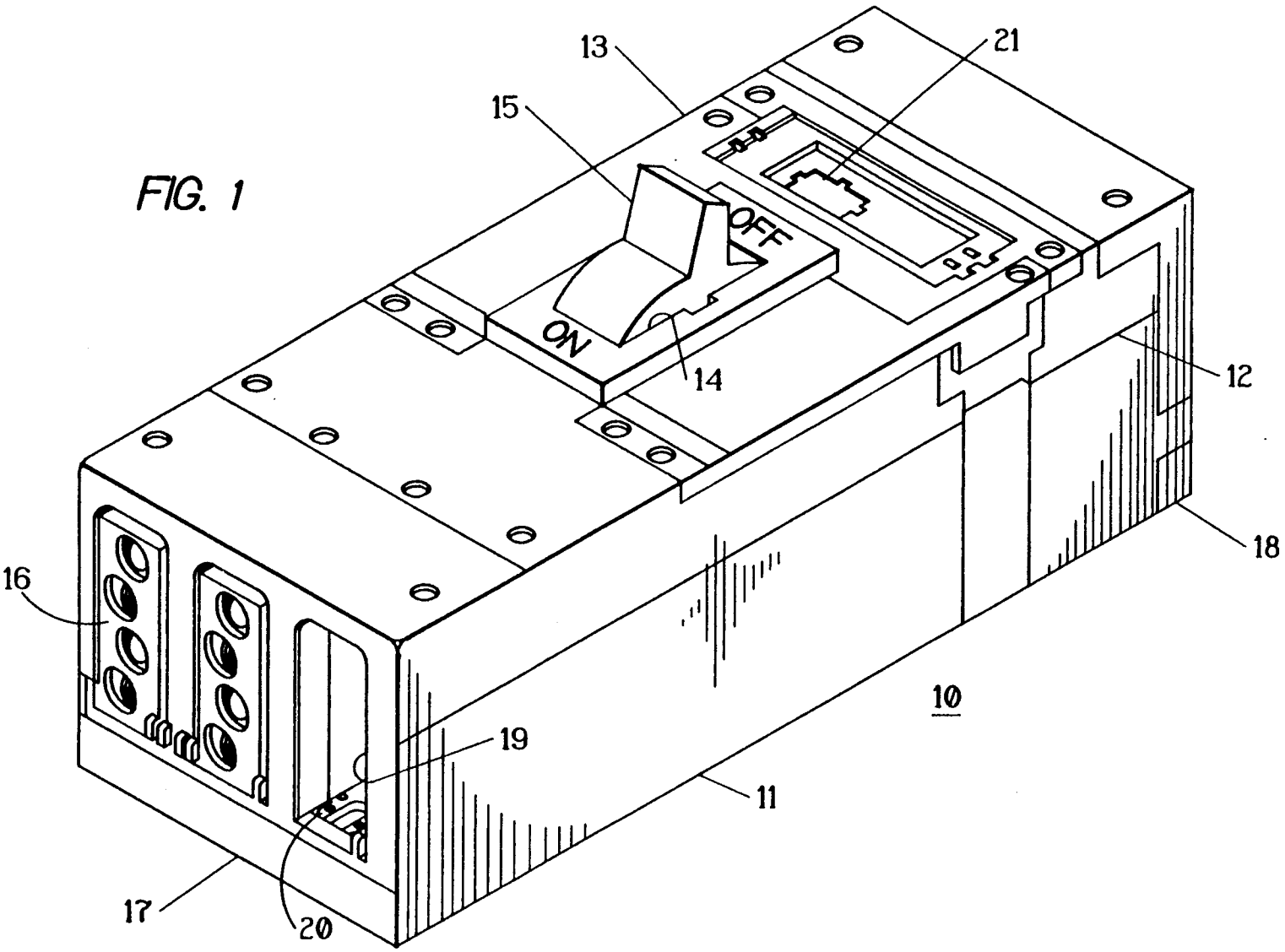
FIG. 1 is a top perspective view of a molded case circuit breaker employing the line strap assembly in accordance with the invention.

An integrated circuit breaker 10 is shown in FIG. 1 and consists of a molded plastic case 11 to which a molded plastic cover 12 is attached. An accessory cover 13 as described in the aforementioned U.S. Pat. No. 4,754,247 is arranged on the top of the cover around the handle slot opening 14 through which the handle operator 15 extends. The rating plug 21 is also accessible from the circuit breaker cover to allow the ampere rating of the circuit breaker to be adjusted as described within aforementioned U.S. Pat. No. 4,649,455. Electrical connection with an industrial power distribution circuit is made by means by the line terminal lugs 16 that are supported upon a line terminal inset 17 within the line terminal compartments 19 and attached to the threaded opening 35. A similar load terminal inset 18 is arranged at the load terminal end, as indicated. The line terminal strap 20 electrically connects with the circuit breaker current-carrying components as best seen by now referring to FIG. 2.

Figure 2:
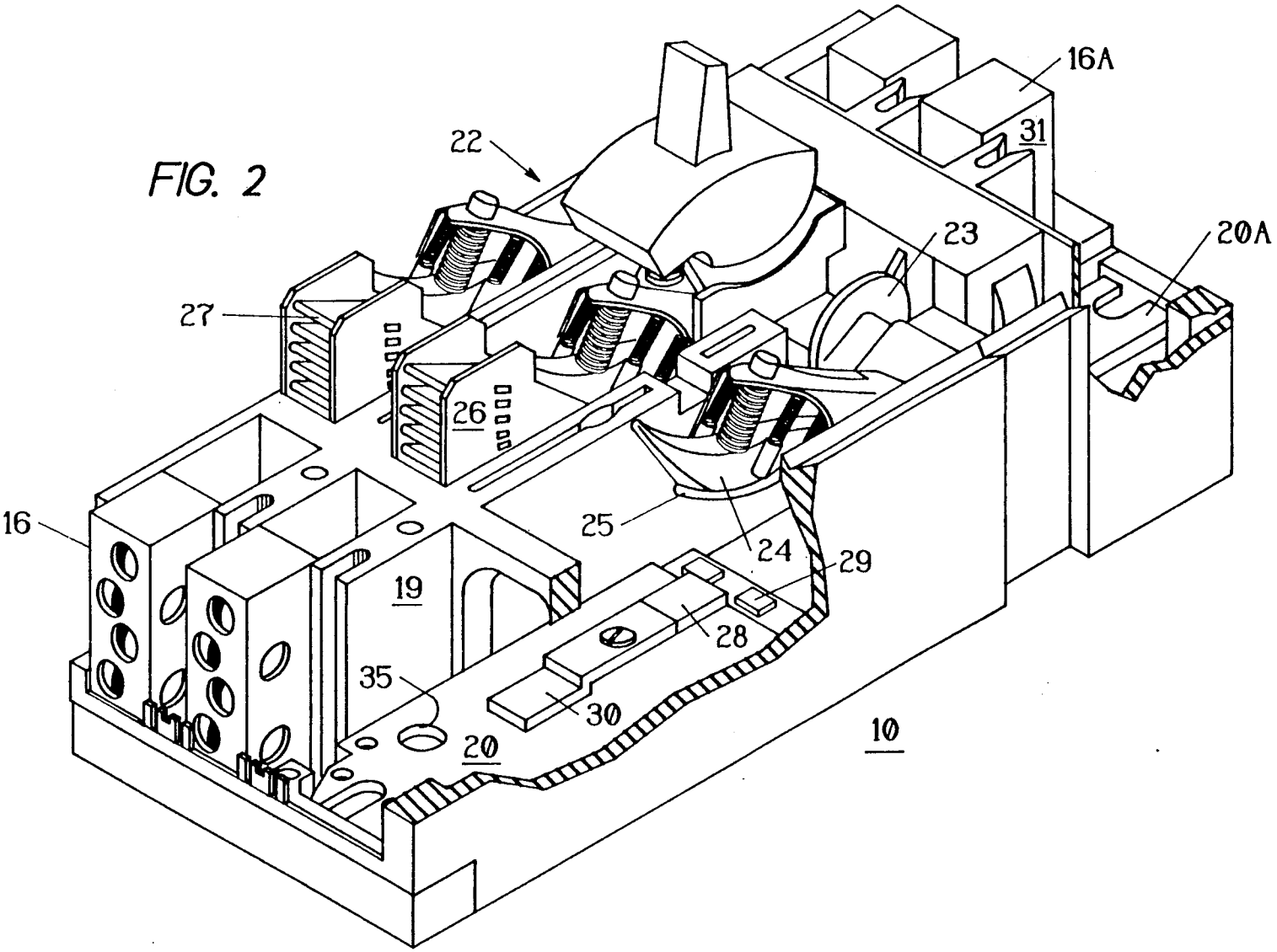
FIG. 2 is a top perspective view of the circuit breaker of FIG. 1 with the cover removed to depict the line strap assembly contained therein.

The circuit breaker 10 is depicted in FIG. 2 with the cover removed to show the circuit breaker operating mechanism 22 which is better described in U.S. Pat. No. 5,004,878 entitled "Molded Case Circuit Breaker Movable Contact Arm Arrangement". The circuit current transfers between the line terminal lugs 16 and line terminal straps 20 that are arranged within the line terminal compartments 19 at one end, through the fixed arcing contact 28. The fixed contacts transfer current to the movable arcing contacts 25 that are arranged on the movable arcing contact arms 24 and which connect with the load terminal straps 20A and load terminal lugs 16A arranged within the load terminal compartment 31. Upon the occurrence of an overcurrent condition, the operating mechanism lifts the movable arcing contact arms 24 to rapidly separate the movable arcing contacts 25 from the fixed arcing contact 28, and thereby separate the circuit existing between the line and load terminal lugs. The current transfers from the fixed main contacts 29 to the fixed arcing contacts 28 and then to the associated arc runners 30. The arc that is generated during the contact separation is extinguished in the arc chutes 26 within the arc plates 27. The crossbar 23 interconnects each of the three movable arcing contact arms 24 to insure that the contact arms respond simultaneously within the operating mechanism 22.

Figure 3:
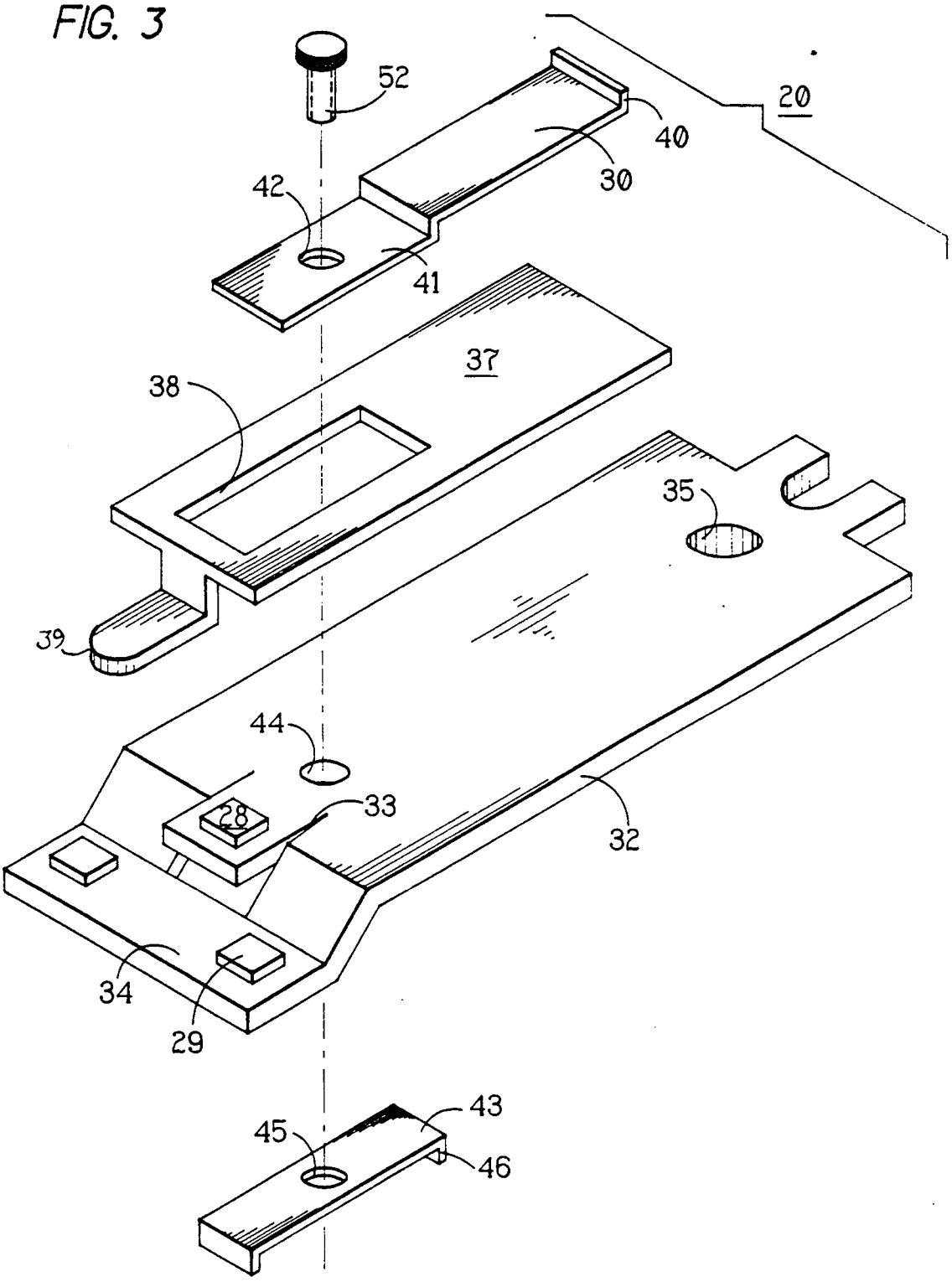
FIG. 3 is an enlarged top perspective view of the components of the line strap assembly of FIG. 2 in isometric projection.

In accordance with the invention, the line strap 20 is shown in FIG. 3 to consist of a basic support plate 32 of silver-plated copper stock which is formed to an off-set end 34 to which the fixed main contacts 29 of a silver alloy are attached. The lanced upper part 33 supports the fixed arcing contact 28 also formed from a silver alloy. A thru-hole 44 formed in the support plate locates both the arc runner 30 and the high temperature plastic insulating plate 37 on the support plate 32. The off-set end 41 is sized to fit within the rectangular slot 38 and is attached to the support plate 32 by insertion of the screw 52 through the thru-hole 42 in the offset end 41 through the thru-hole 44 and into the threaded opening 45 of the support 43 to trap the plastic plate 37 between the arc runner 30 and the support plate 32. With the arc runner attached to the support plate, the upstanding tab 40 at the end of the arc runner is operationally positioned at one end of the plastic plate 37 and the tongue 39 extending from the opposite end is operationally positioned between the fixed main contacts 29. Since the thickness of the support plate 32 is reduced to approximately fifty percent of the prior art line strap thickness, additional strength must be provided to compensate for the corresponding reduction in the mass of material. This support is in the form of a U-shaped support brace 43 formed from a metal plate to define a pair of downwardly depending tabs or legs 46, the bottom of which are co-extensive with the bottom of the off-set end 34 of the support plate 32. The threaded opening 45 formed in the support brace is aligned with the thru-holes 42,44 to receive the attachment screw 52. The line strap 20 (depicted in FIG. 2) includes the fixed arcing contact 28 and fixed main contacts 29.

Figure 4:
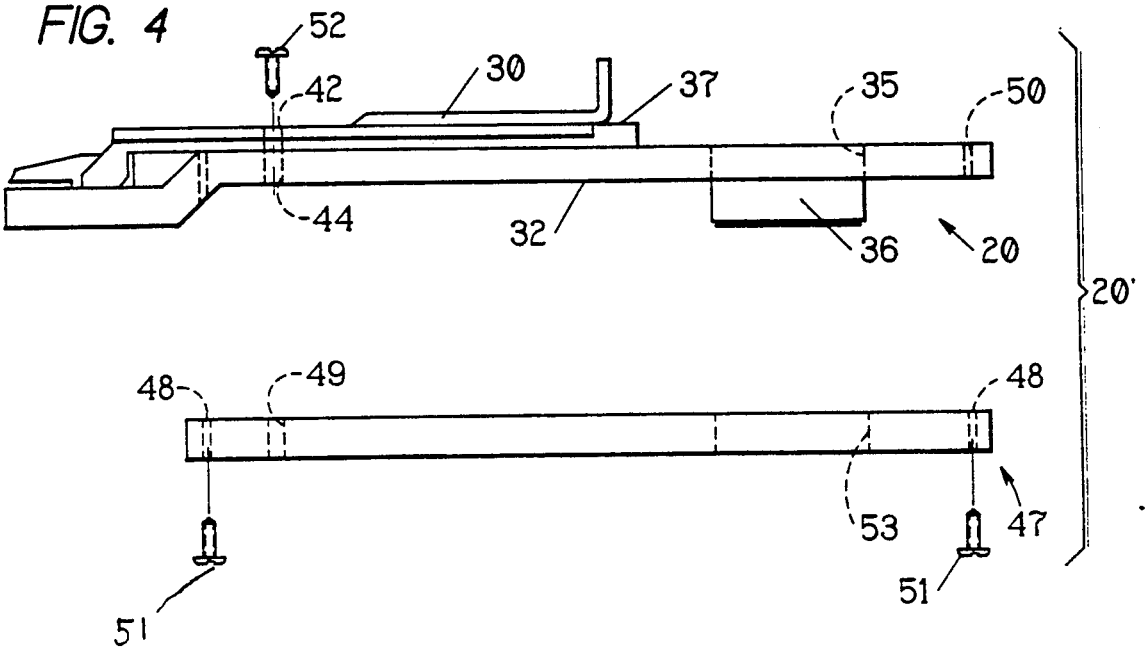
FIG. 4 is a side view of the line strap assembly of FIG. 3 prior to attaching a high current-carrying component.
Figure 5:
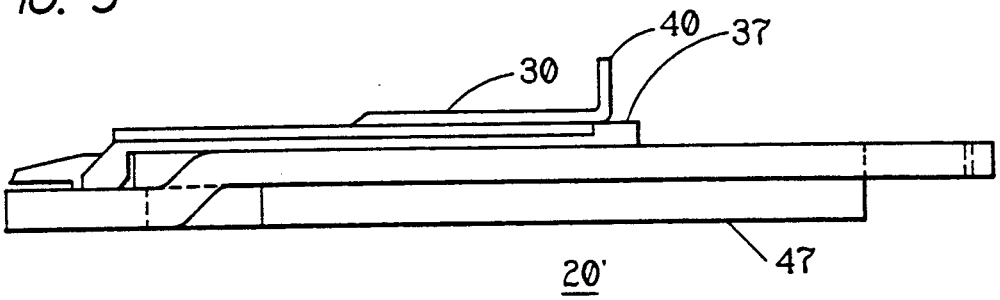
FIG. 5 is a side view of the line strap assembly of FIG. 3 with the high current-carrying component attached.

When the line strap 20 shown assembled in FIG. 4 is to be used within a higher rated circuit breaker assembly, a conductive plate 47 consisting of silver-plated copper is attached to a bottom part thereof in place of the U-shaped support brace, described earlier. The conductive plate includes an opening 53 oversized to receive the collar 36 extending from the bottom of the thru-hole 35 formed in the line strap support plate 32. The conductive plate 47 is attached to the support plate 32 by welding or brazing. The conductive plate can also be attached by means of thru-holes 48 in the conductive plate, threaded openings 50 in the support plate and screws 51 to form the higher current line strap 20' shown in FIG. 5. The screw 52 passes though the thru-hole 42 in the arc runner 30, the thru-hole 44 in the support plate 32 and the threaded opening 49 in the conductive plate 47 to provide further attachment between the conductive plate 47 and the support plate 32. The attachment of the conductive plate increases the mass of the line strap such that the support brace 43 of FIG. 3 is no longer required.

A modular line strap assembly having both high and low current capability has herein been described. The arrangement of an additive conductive plate allows higher currents to transfer without adverse heating while the absence of the conductive plate allows lower currents without over-heating and at a substantial cost savings.

Having thus described my invention, what I claim as new and desire to secure by Letters Patent is:

1. A molded case circuit breaker line strap assembly comprising in combination:
   - an electrically-conductive support plate having means at one end for receiving a line terminal connector;
   - an electrically-insulative plate having an aperture formed within one end and arranged on a top surface of said support plate;
   - an arc runner having an off-set formed at one end and an upturned tab formed at an opposite end thereof, said off-set being arranged within said aperture and tab being arranged over said insulative plate; and
   - a U-shaped brace attached to a bottom surface of said support plate providing additional support to said support plate.

2. The line strap assembly of claim 1 including a first aperture formed within said off-set, a second aperture formed within said support plate co-extensive with said first aperture and a third aperture formed within said brace co-extensive with said first and second apertures.

3. The line strap assembly of claim 2 including means extending through said first, second and third apertures to fasten said arc runner to said support plate and said attached means whereby said insulative plate is trapped between said arc runner and said support plate.

4. The line strap assembly of claim 2 including a lanced part formed on said support plate supporting a fixed arcing contact.

5. The line strap assembly of claim 1 including a pair of fixed main contacts attached to said off-set.

6. The line strap assembly of claim 1 including a tongue formed at one end of said insulating plate and arranged intermediate said main contacts.

7. The line strap assembly of claim 1 wherein said line terminal receiving means comprises a threaded opening formed within said support plate.

8. The line strap assembly of claim 7 including a collar on a bottom surface of said support plate, subjacent said receiving means.

9. The line strap assembly of claim 1 wherein said attached means comprises a conductive plate.

10. The line strap assembly of claim 9 wherein said conductive plate includes an opening sized to receive said collar.

11. The line strap assembly of claim 9 wherein said conductive plate is welded or brazed to said support plate.

* * * * *